United States Patent [19]

Schildkraut

[11] 4,289,368

[45] Sep. 15, 1981

[54] FULL MATE INDICATOR FOR DETACHABLE CONNECTORS

[75] Inventor: Alan L. Schildkraut, Sidney, N.Y.

[73] Assignee: The Bendix Corporation, Southfield, Mich.

[21] Appl. No.: 71,441

[22] Filed: Aug. 31, 1979

[51] Int. Cl.[3] ..... H01R 13/62

[52] U.S. Cl. ..... 339/89 M; 339/113 R

[58] Field of Search ..... 339/89, 90 R, 90 C, 339/113 R, DIG. 2; 285/93

[56] References Cited

U.S. PATENT DOCUMENTS

| | | | |
|---|---|---|---|
| 3,808,580 | 4/1974 | Johnson | 339/DIG. 2 |
| 3,960,428 | 6/1976 | Nans et al. | 339/DIG. 2 |
| 4,059,324 | 11/1977 | Snyder et al. | 339/113 R |
| 4,076,361 | 2/1978 | Campbell | 339/113 R |

OTHER PUBLICATIONS

IBM Technical Disclosure Bulletin: Clicking Connector, M. C. Panaro, vol. 1, No. 4, 12/1958.

*Primary Examiner*—John McQuade

*Attorney, Agent, or Firm*—Paul J. Ethington; Raymond J. Eifler; Charles D. Lacina

[57] ABSTRACT

An electrical connector is disclosed with means for producing a tactile signal when the connector members (10,12) are in a fully mated condition. An indicator (60) is movably mounted on the coupling nut (14) and is engageable by the opposed connector member (10) when the members are in a fully mated condition. An indicator element (60) is disposed in a passage (64) in the wall of the coupling nut (14) and a cam shaped surface (66) on the indicator element engages the starting end (72) of the thread (26) of the opposed member which causes it to move abruptly, i.e. "pop out" to a signal position when the full mate condition is reached.

5 Claims, 7 Drawing Figures

FULL MATE INDICATOR FOR DETACHABLE CONNECTORS

TECHNICAL FIELD

This invention relates to connectors and more particularly to detachable connectors of the type including a coupling nut for coupling and decoupling a plug and receptacle.

BACKGROUND ART

A typical electrical connector comprises a plug member and a receptable member with a set of pin contacts on one member and a set of socket contacts on the other member. A coupling nut is rotatably mounted on one of the members and adapted for threaded engagement with the other member whereby the plug and receptacle members may be drawn together in an axial motion and without relative rotation, by rotation of the coupling nut.

In the use of such connectors, there has been a problem of making certain that the coupling nut has been advanced sufficiently so that the plug and receptacle shells are fully mated, i.e., the contacts are properly engaged; also in some connectors, metal-to-metal contact of the shells is important for electrical shielding and for stability of the mated conditions during vibration. Although the user may tighten the coupling nut until it feels like it has reached a stop or has "bottomed out", this may be misleading if the coupling nut is jammed or a foreign object interferes. Also, the use of soft elastomeric sealing gaskets makes it difficult to feel when the mating plug and receptacle shells have bottomed out. There is a need for means to provide a positive and unambiguous indication to the user that the coupling nut has advanced to a predetermined position and that the plug and receptacle are fully mated.

In the prior art, it is a common practice to provide a sight line on one of the connector members in such as position that it will be covered by a coupling nut when the full mate condition is reached. This allows a visual check for the full mate condition but it is ineffective when the connector is in a dark location or unaccessible to the view of the user. A connector with a detent means which also serves as an indicator is disclosed in U.S. Pat. No. 4,059,324.

A general object of this invention is to provide an improved means for indicating when a plug and receptacle are fully mated.

SUMMARY OF THE INVENTION

In accordance with this invention, a separable connector is provided with means for producing a tactile signal when the connector members are in a fully mated condition. This is accomplished by an indicator element movably mounted on one of the members and engageable by the other when the members are in the fully mated relationship. Preferably, the indicator element is slidably retracted until the full mate condition is reached and then it is extended to a signal position in which it can be felt by the user's hand. The indicator element is preferably disposed in a passage in the wall of the coupling nut so that it engages the starting end of the thread on the connector member when the coupling nut reaches the rotative position corresponding to the full mate condition. The indicator element is spring biased to a retracted position and is adapted to move abruptly; i.e. "pop out", to a signal position when the full mate condition is reached.

BEST MODE FOR CARRYING OUT THE INVENTION

Figure 1:
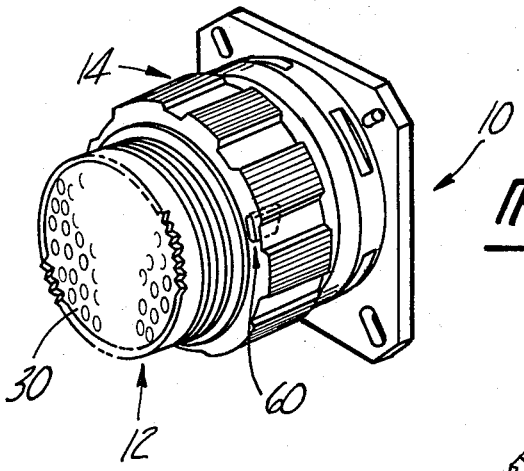
FIG. 1 is a perspective view of a connector embodying the subject invention.
Figure 2:
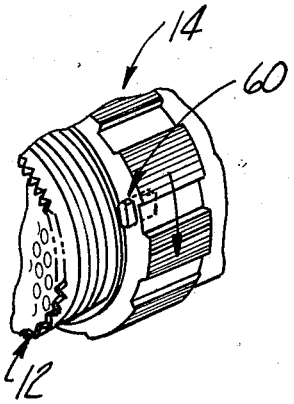
FIG. 2 is a fragmentary view of the connector showing parts in an alternate position.

Referring now to the drawings, there is shown an illustrative embodiment of the invention in an electrical connector of the type comprising a plug member and receptacle member which are detachably connected by a coupling nut. In this illustrative embodiment, the electrical connector is adapted for connecting the conductors of a multiple-conductor device, such as a cable to the corresponding conductors of another device. One member of the connector is provided with terminals for the conductors in the form of pin contacts and the other member is provided with terminals in the form of socket contacts. It will be appreciated as the description proceeds, that the invention may be embodied in a wide variety of electrical connectors and also in other types of connectors, such as optical fiber connectors wherein terminals are provided for the fibers and pairs of terminals must be coupled together.

In the illustrative embodiment to be described, the invention is incorporated in a electrical connector of standard construction with only a slight modification.

Figure 3:
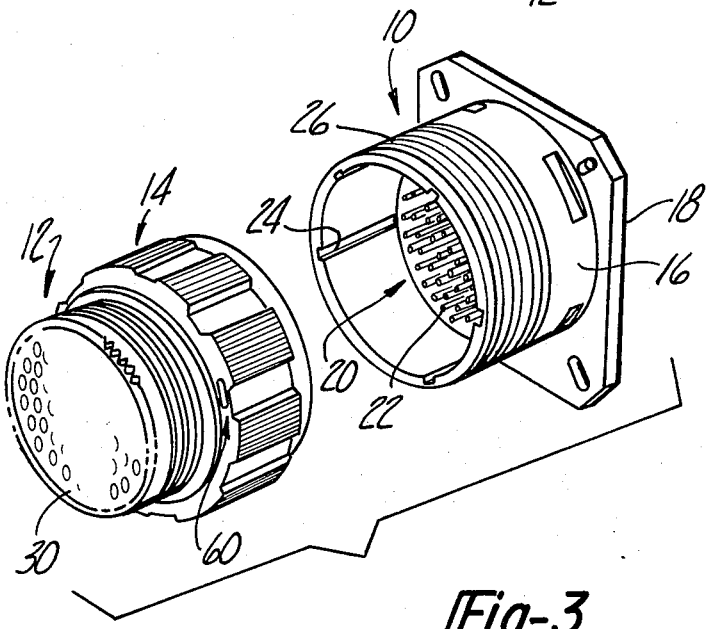
FIG. 3 is an exploded view of the connector embodying the subject invention.

The electrical connector, as best shown in FIGS. 1 and 3, comprises a first member or receptacle 10 which is adapted to receive a second member or plug 12 in a mated relationship. The plug and the receptacle are detachably connected by a coupling nut 14 which is rotatably mounted on the plug 12.

The receptacle 10 comprises a cylindrical shell 16 which is provided with a mounting flange 18 adapted to be secured to a bulkhead or the like. The shell 16 contains an insert 20 which carries a plurality of terminals in the form of conductive pin contacts 22. Each pin contact is adapted to receive a selected conductor from a plurality of conductors (not shown) at the rearward end of the receptacle 10. The plurality of conductors to be connected with the respective pin contacts 22 may be the terminals of another connector member or the wires of a cable. The cylindrical shell 16 of the receptacle is provided on its inner surface with a plurality of keyways 24 for the purpose of orienting the plug 12 with the receptacle 10. Additionally, the cylindrical shell 16 of the receptacle is provided with external screw threads of the triple start type, including threads 26, 26' and 26" (see FIG. 4).

Figure 4:
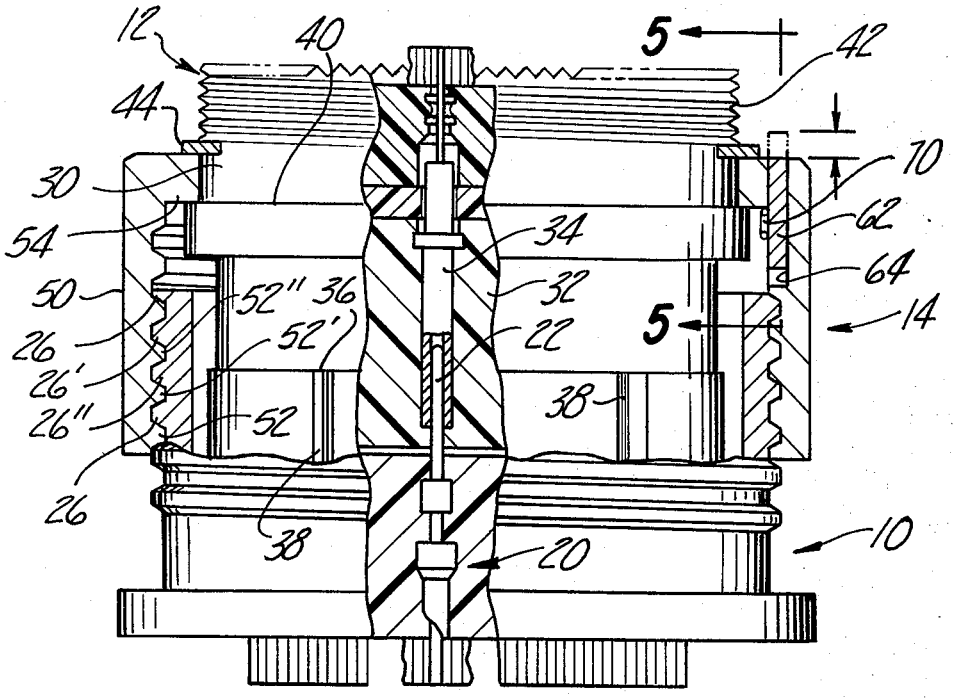
FIG. 4 is an elevation view with parts broken away.

The plug 12 comprises a cylindrical shell 30 which contains an insert 32 (see FIGS. 3 and 4). The insert carries a plurality of terminals in the form of socket contacts 34. Each of of the socket contacts 34 is adapted to receive a selected conductor from a cable (not shown) and each corresponds with a certain one of the pin contacts 22. The forward end of the shell 30 is adapted to be inserted, in a clearance fit in telescopic relation inside the shell 16 of the receptacle 10. The shell 30 of the plug 12 comprises a rim 36 at its forward end and a plurality of axially extending keys 38 are formed in the rim. The keys 38 are adapted to be aligned with the keyways 24 for orientation of the plug relative to the receptacle. The shell 30 includes near its midsection an annular flange 40 which is adapted to receive and position the coupling nut 14, in a manner to be described subsequently. The rearward end of the cylindrical shell 30 is provided with an external thread 42 for receiving a cable nut (not shown), or the like. Additionally, the shell 30 defines an annular slot which receives a snap ring 44 to retain the coupling nut 14 on the plug.

As shown in FIG. 4, the coupling nut 14 comprises a cylindrical sleeve 50 which is provided with internal threads 52, 52' and 52'' of the triple start type to mate with the threads 26, 26' and 26'' on the receptacle. Additionally, the nut 14 comprises an annular, inwardly directed flange 54 which is adapted to receive the shell 30 of the plug 12 in a clearance fit with the flange 40 of the shell 30 seated against the flange 54. The coupling nut 14 is axially retained on the shell 30 of the plug by the snap ring 44.

When the plug 12 is to be connected with the receptacle, the forward end of the plug shell 30 is placed in alignment with the forward end of the receptacle shell 16. The plug 12 is oriented so as to align the keys 38 with the keyways 24 which insure that the plug and the receptacle will approach each other with axial motion only, i.e. without any rotative displacement. Accordingly, each pin contact 22 will be aligned with its corresponding socket contact 34 for telescoping engagement when the plug and receptacle are drawn toward the fully mated relationship. It is noted that the threads 52, 52' and 52'' on the coupling nut 14 and the corresponding threads on the shell 16 have a thread pitch which is substantially the same as the length of that portion of the pin contact 22 which extends beyond the face of the insert 20. Accordingly, with the coupling nut oriented to the starting position of the threads, one complete revolution of the coupling nut will pull the receptacle and plug together into a fully mated condition. In this condition, the pin contacts 22 are fully inserted into the socket contacts 34 and the forward end of the flange 40 of the plug is seated against the forward edge of the shell 16 of the receptacle. When the plug and receptacle are in the fully mated relationship, the contacts are operatively coupled and the shells are in metal-to-metal contact.

According to this invention, the connector described above is provided with means for indicating when the plug and receptacle are in fully mated condition. This is provided by a tactile signal indicator 60 which is disposed in the coupling nut 14. The indicator 60 comprises a plunger 62 which is slidably disposed in an axial passage 64 in the rim of the coupling nut 14. The plunger 62 has an actuating end with a tapered cam surface 66 at the forward end of the passage 64. It has a signalling or indicator end 68 at the rearward end of the passage. The passage 64 is of such depth that the indicator end 68 is flush with the rear surface of the coupling nut 14 when the actuating end 66 is seated against the bottom of the passage 64. The plunger 62 is biased toward the forward end of the coupling nut and hence against the bottom of the passage 64 by a wire spring 70. The wire spring 70 has a central portion which extends transversely of the body 62 and is attached thereto by an adhesive. The spring 70 has end portions extending obliquely from the central portion and which are seated against the forward surface of the flange 54 on the coupling nut. Thus, the spring 70 is resiliently yieldable to permit the plunger 62 to be moved outwardly of the passage 64 so that the indicator end 68 projects beyond the rearward surface of the coupling nut 14. The plunger 62 coacts with the receptacle 10 in a manner such that the indicator end 68 is flush with the surface of the coupling nut when the plug and receptacle are not fully mated and it projects beyond the surface when the fully mated condition is reached. The manner in which the body 62 coacts with the receptacle 10 will now be described.

Figure 5:
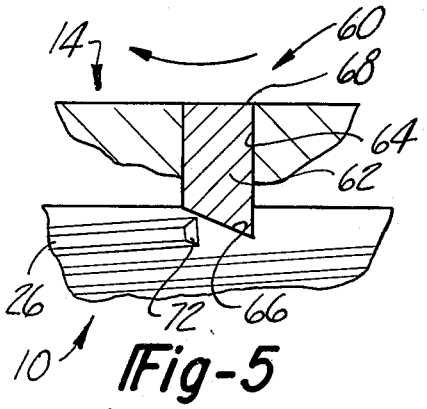
FIG. 5 is a view taken on line 5—5 of FIG. 4.
Figure 6:
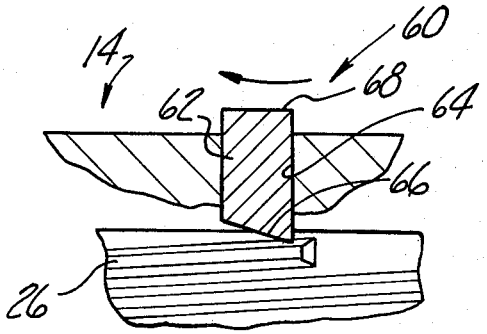
FIG. 6 is a view similar to FIG. 5 with parts in an alternate position.
Figure 7:
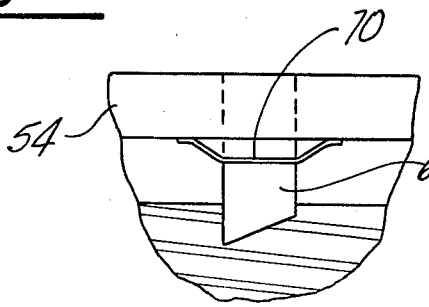
FIG. 7 shows a detail of construction.

As shown in FIG. 4, the passage 64 extends axially into the coupling nut 14 at a radial location on the coupling nut so that the outer wall of the passage is at or near the root diameter of the threads 52, 52' and 52''. The passage 64 extends through the rear threads to an axial position which will be reached by the starting end of the threads 26, 26' and 26'' when the full mate condition is reached. The passage 64 is located circumferentially in approximate axial alignment with the start of the thread 52 at the forward end of the coupling nut 14. Consequently one revolution of the coupling nut from its starting position advances the coupling nut axially so that the actuating end 66 of the plunger 62 is brought into engagement with the starting end 72 of the thread 26 (or the starting end of thread 26' or 26'') on the receptacle. As shown in FIG. 5, the relationship of the coupling nut 14 and receptacle 10 is depicted with the coupling nut advanced clockwise by approximately one revolution from the start of thread engagement. In this rotative position of the coupling nut, the plunger 62 remains in its retracted position and the rearward end 68 is flush with the surface of the coupling nut. FIG. 6 depicts the relationship with the coupling nut advanced further by an angular increment approximately corresponding to the width of the plunger 62. This additional rotation causes the tapered cam surface 66 of the plunger to engage the starting end 72 of the thread and to be cammed outwardly thereby to a fully extended position. This indicates that the plug and receptacle have been fully mated and that the contacts are coupled together and the shells are in metal-to-metal contact. If the coupling nut should be advanced beyond this position, the indicator body 62 is held in the extended or signal position by the engagement of the cam surface 66 with the thread 26.

The indicator of this invention gives a positive tactile signal when the plug and receptacle are in the fully mated condition. The user can feel the indicator end 68 of the plunger when it is projected beyond the surface of the coupling nut by simply passing his finger over that part of the coupling nut. Also, if the location and lighting permit, the indicator provides a visual signal that the plug and receptacle are fully mated.

Although the description of this invention has been given with reference to a particular embodiment, it is not to be construed in a limiting sense. Many variations and modifications will now occur to those skilled in the art. For a definition of the invention, reference is made to the appended claims.

What is claimed is:

1. In a connector assembly of the type having first and second connector members adapted to be moved between a detached relationship and a fully mated relationship by a coupling nut rotatably mounted on the first connector member, each connector member including at least one terminal corresponding to a terminal on the other connector member, the corresponding terminals being coupled when the connector members are disposed in the fully mated relationship position, the improvement comprising:

an indicator element movably supported by said coupling nut for movement between a reference position and a signal position; and a spring biasing said indicator element toward its reference position;

said coupling nut comprising a cylindrical shell having forward and rearward faces and an internal wall, screw thread on the internal wall and a passage disposed in the internal wall, said passage extending axially from the rearward face of said coupling nut and being in alignment with a selected part of the second connector member;

said second connector member having external screw thread adapted to be engaged by the said internal screw thread;

said indicator element being slidably disposed in said passage and having an actuator portion engageable with the selected part of the second connector member when the connector members are in said fully mated relationship whereby as the coupling nut is rotated, the connector members are moved to the fully mated relationship and the indicator element is moved to the signal position when the terminals are coupled.

2. The invention as defined in claim 1 wherein said passage extends through said internal screw threads on said coupling nut, said selected part is the starting end of the external thread on the second connector member and said actuator portion is disposed so as to engage the starting end of the external thread when the fully mated condition is reached.

3. The invention as defined in claim 2 wherein said biasing spring comprises a spring wire having one portion seated on said first connector member and another portion operatively connected with said indicator element for urging said indicator element toward said reference position.

4. The invention as defined in claim 2 wherein said actuating portion includes a cam surface for causing abrupt movement of said indicator element.

5. In combination, a connector assembly comprising a pair of detachable connector members, a coupling nut rotatably mounted on one of the connector members, said connector members being movable by the coupling nut between a detached relationship and a fully mated relationship, an indicator element mounted in the coupling nut for providing a tactile signal when the connector members are in the fully mated relationship, the indicator element having an actuator portion for engaging the other connector member and a signal portion slidably retracted into a concealed position of the coupling nut when the members are not fully mated and extended into a signal position with the signal portion protruding beyond a surface of said coupling nut when the members are fully mated and a spring interconnecting the indicator element and the coupling nut for biasing said indicator element toward the retracted position.

* * * * *